US007004302B1

(12) United States Patent
Hensen

(10) Patent No.: US 7,004,302 B1
(45) Date of Patent: Feb. 28, 2006

(54) TURNTABLE

(75) Inventor: Henno Hensen, Bremen (DE)

(73) Assignee: Fresenius Kabi Deutschland GmbH, Frankfurt (DE)

( * ) Notice: Subject to any disclaimer, the term of this patent is extended or adjusted under 35 U.S.C. 154(b) by 0 days.

(21) Appl. No.: 10/275,881

(22) PCT Filed: May 19, 2000

(86) PCT No.: PCT/EP00/04540

§ 371 (c)(1),
(2), (4) Date: Mar. 17, 2003

(87) PCT Pub. No.: WO01/85545

PCT Pub. Date: Nov. 15, 2001

(30) Foreign Application Priority Data

May 12, 2000 (DE) ..... 100 23 278

(51) Int. Cl.
*B65G 29/00* (2006.01)
*B65B 43/26* (2006.01)

(52) U.S. Cl. ..... 198/473.1; 53/570; 53/459; 248/349.1

(58) Field of Classification Search ..... 248/349.1; 209/522; 198/473.1, 480.1; 141/12; 53/570, 53/438, 459
See application file for complete search history.

(56) References Cited

U.S. PATENT DOCUMENTS 2,985,283 A * 5/1961 Carter ..... 198/341.07
3,381,446 A * 5/1968 Marchand ..... 53/562
3,406,727 A * 10/1968 Rexus ..... 141/131
4,033,093 A * 7/1977 Mencacci ..... 53/512
4,075,086 A * 2/1978 Marsh et al. ..... 209/522
4,192,359 A * 3/1980 Pippin ..... 141/12
4,423,583 A * 1/1984 Carey ..... 52/373
4,473,989 A 10/1984 Tsutsumi et al.
4,852,415 A * 8/1989 Bogatzki et al. ..... 73/865.8
4,994,135 A 2/1991 Orlandi
5,085,515 A * 2/1992 Itoh et al. ..... 356/398
5,314,825 A * 5/1994 Weyrauch et al. ..... 436/43
5,555,709 A * 9/1996 Savigny et al. ..... 53/570
5,653,092 A * 8/1997 Gorby et al. ..... 53/438
5,682,026 A * 10/1997 Auclair et al. ..... 235/375

FOREIGN PATENT DOCUMENTS

DE 10 69 070 B 11/1955

* cited by examiner

*Primary Examiner*—Anita M. King
(74) *Attorney, Agent, or Firm*—David S. Safran

(57) ABSTRACT

A turntable for the treatment of container for fillable goods with receiving places (1) for the container and with at least one treatment unit for the container received in the receiving places (1). In such a generic turntable the arrangement of several treatment units is enabled in that the receiving places (1) are arranged in interior carrousels (2) arranged on the turntable, the interior carrousels (2) are provided with rotary drives for rotating the receiving places (1) on at least two predetermined radii (3, 4, 5) of the turntable and at least one treatment unit each for the container is arranged on the predetermined radii (3, 4, 5).

6 Claims, 2 Drawing Sheets

TURNTABLE

BACKGROUND OF THE INVENTION

1. Field of the Invention

The invention relates to a turntable for the treatment of containers for fillable goods with receiving places for the containers and with at least one treatment unit for the containers received in the receiving places.

2. Description of Related Art

The generic turntables for the treatment of containers for fillable goods are known in a plurality of embodiments, adapted to the different containers shapes and different goods that can be filled therein. Containers worth mentioning, for example, are glass or polyethylene bottles, cans, etc. Goods that can be filled in these containers are understood as being the following, for example: beverages, fluid or thick-flowing personal hygiene products, foodstuffs, animal food as well as pourable goods, such as rice, for example.

Turntables are usually used when it is necessary to fill, to screw closed, to seal or perform similar treatments with containers with high frequency. These high frequencies are enabled in such a way that the containers, following their receipt in the receiving places, are available for the treatment by the treatment units assigned to the receiving places for an approximate period of time which passes during a complete rotation of the turntable. All containers disposed in the receiving places on a turntable are continuously subjected to the treatment, e.g., the screwing on of a lid, thus achieving a high frequency, on the one hand, and securing a continuous treatment, on the other hand.

In order to continuously supply the known turntables with containers, so-called accumulating conveyors are usually used, at the outlet of which the containers are singled out via a feed screw in order to be supplied to a feed star which supplies the containers to the turntable at a delivery point, which is also partly known as a turning star. Partly, the containers are taken from the receiving places by means of an outlet star in the outlet section or are supplied directly to a conveyer.

The known turntables for the treatment of containers for fillable goods are merely provided with one treatment unit which usually treats in parallel a number of containers in the receiving places. For example, the containers are filled in a filling star by a filling unit. As a rule, however, a number of working steps, such as the cleaning, filling, screwing on of returnable bottles are necessary for the complete treatment of containers for fillable goods in order to produce the final product. In the known installations for the treatment of containers, a plurality of turntables are used which are specialized in the respective treatment, such as the filling, for example, and which deliver the containers partly via feed stars and/or outlet stars to interposed conveyors, or which receive from the same.

The problematic aspect in installations composed of the conventional turntables which allow treatment of containers is that they require a relatively high amount of floor space due to the plurality of the required turnstiles and feed and outlet stars. Moreover, every receipt or delivery of the containers to and from a turntable leads to a relatively high mechanical effort, thus causing additional wear and tear and additional susceptibility to malfunctions.

SUMMARY OF THE INVENTION

Based on the aforementioned state of the art, it is an object of the present invention to provide and further develop a turntable for the treatment of containers for fillable goods in such a way that several treatments of containers for fillable goods are possible in a single turntable without interposed discharge or receiving means for the container.

This object in accordance with the invention for a turntable for the treatment of containers for fillable goods is achieved in such a way that the receiving places are arranged in interior carrousels disposed on the turntable, the interior carrousels are provided with rotary drives for rotating the receiving places on at least two predetermined radii of the turntable and at least one treatment unit for the containers each is arranged on the predetermined radii.

In the turntable in accordance with the invention, the containers received in the receiving places are moved on different radii, depending on the position of the interior carrousels relative to the turntable, which carrousels rotate together with the turntable, and can thus be supplied to the treatment units which are arranged on different radii of the turntable. Once the containers of a treatment unit have been filled, for example, the interior carrousels will continue to rotate in such a way that the containers received in the receiving places are moved to another radius on which a further treatment unit performs a further treatment of the container. The turntable in accordance with the invention thus allows the successive treatment of containers received in the receiving places on different radii by means of treatment units assigned to said radii without forcing the container, within each treatment step, to be discharged from the turntable or to be received by a new turntable for the further treatment. As a result, the turntable in accordance with the invention considerably simplifies the arrangement and reduces the space requirement of installations for the treatment of containers for fillable goods.

The parallelism of the treatment of the containers to be filled can be improved even further in that two treatment units which are assigned to two different angular ranges are provided on a predetermined radii between the outermost radius and the innermost radius of the receiving places. Two possible positions of the receiving places in the interior carousel are obtained on the radii between the outermost and the innermost radius of the receiving places, namely one in the direction of rotation before and after the position on the outermost or innermost radius. Both positions can be assigned a separate treatment unit, since although the containers received in the receiving places are located on the same radius, they are disposed in different angular ranges of the turntable.

The control, which under certain circumstances may be somewhat complex, can be ensured in a particularly simple way in that the rotary drives of the interior carrousels are arranged as stepper motors. Such stepper motors can be moved by computer control without much effort and with high precision in predetermined angular steps.

In addition to the containers for receiving fillable goods as were already mentioned above by way of an example, so-called stand-up pouches are gaining in importance. Accordingly, the turntable in accordance with the invention is arranged particularly preferably in such a way that the receiving units are arranged for receiving the stand-up pouches. The reception of stand-up pouches can be realized by clamping jaws gripping the welded edges of the stand-up pouch, pouring guide means engaging into adapted recesses of any optionally provided pouring spouts, or receiving places adapted to carriers for stand-up pouches, which carriers are described in an application simultaneously filed by the same applicant, U.S. patent application Ser. No. 10/275,884.

There are a large number of possibilities to arrange and further develop the turntable in accordance with the invention as will be apparent from the following detailed description considered in conjunction with the accompanying drawings.

DETAILED DESCRIPTION OF THE INVENTION

Figure 1:
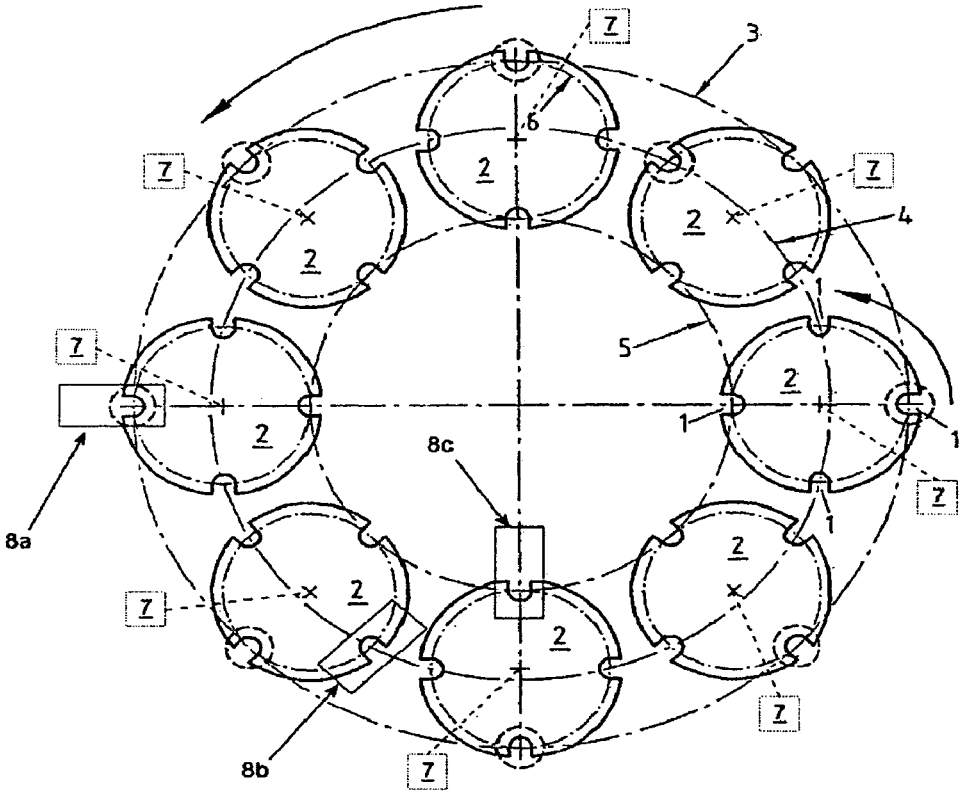
FIG. 1 schematically shows a top view of an embodiment of a turntable in accordance with the invention in a first state and FIG. 2 schematically shows a top view of an embodiment of a turntable in accordance with the invention in a second state.
Figure 2:
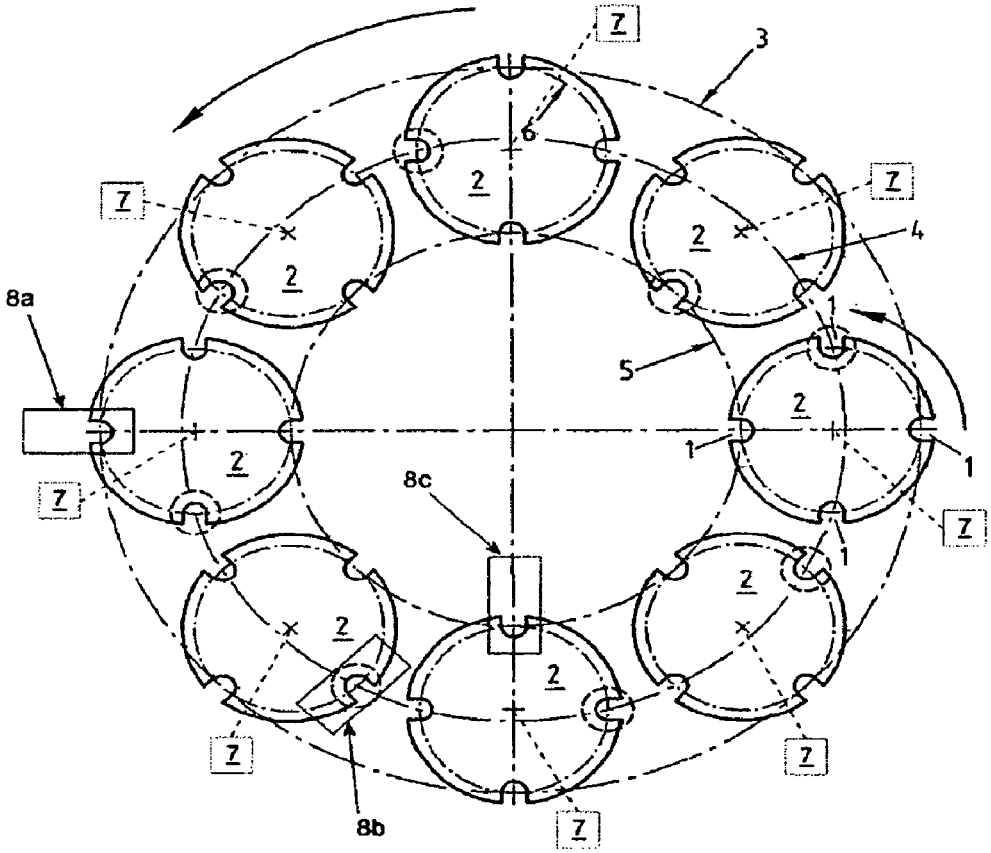

In the embodiment of a turntable in accordance with the invention as exhibited in FIGS. 1 and 2, the receiving places 1 for the containers (not shown) are arranged in interior carrousels 2 arranged on a rotating turntable frame (not shown). The interior carrousels 2 are rotatable with respect to the turntable frame (not shown) by way of rotary drives. e.g. stepper motors 7 and thus allow the relative rotation of the receiving places with respect to the turntable frame, thus enabling the receiving places 1 to reach the predetermined radii 3, 4, 5. The distance between the outermost radius 3 and the innermost radius 5 corresponds to twice the radius 6 of an interior carrousel 2. For the treatment of the containers (not shown) on the predetermined radii 3, 4, 5, which containers are received in the receiving places 1, at least one treatment unit for the containers is arranged on each of said predetermined radii 3, 4, 5, treatment units 8*a*, 8*b*, and 8*c* being shown for the present embodiment.

As a result of the design of the embodiment in accordance with the invention, as exhibited in the drawing, the simultaneous treatment of containers (not shown) received in receiving places 1 which move on different radii 3, 4, 5 is ensured.

In the first state as illustrated in FIG. 1, the containers received in the receiving places 1 during the last rotation about 360° of the turntable are located at the marked positions, i.e., for all interior carrousels 2 with the exception of the interior carrousel 2 located at position 1:30 o'clock on the outermost radius 3. The interior carrousel 2 which is located in the illustrated state at position 1:30 o'clock has been turned by 90' counter-clockwise between the position 3:00 o'clock and 1:30 o'clock, as a result of which the marked receiving place 1 of said interior carrousel 2 now moves on the middle radius 4.

FIG. 2 shows a second state of the embodiment of the turntable in accordance with the invention following a further rotation of the turntable frame counter-clockwise about 360° as compared with the state as shown in FIG. 1. The marked receiving places 1 correspond to the receiving places 1 already marked in FIG. 1. As is shown, in the second state as is illustrated in FIG. 2, all marked receiving places 1, with the exception of the marked receiving place 1 on the interior carrousel 2 at position 1:30 o'clock, are located on the middle radius 4 after the associated interior carrousels 2 were rotated by 90° counter-clockwise during the preceding rotation of the turntable frame between the positions 3:00 o'clock and 1:30 o'clock. The marked receiving place 1 on the interior carrousel 2 at position 1:30 o'clock has already been rotated again by 90° counter-clockwise during the movement from the position 3:00 o'clock to the position 1:30 O'clock, so that this receiving place 1 is now located on the innermost radius 5.

During the rotation between the first state as exhibited in FIG. 1 and the second state as exhibited in FIG. 2, the receiving places are at first charged again with containers (not shown) on the outermost radius 3 from which the previously completely treated containers were removed. The containers are filled during the further rotation by the treatment unit 8*a* assigned to the outermost radius 3.

During the second state as exhibited in FIG. 2, the containers (not shown) received in the marked receiving places 1 are sealed by a treatment unit 8*b* for sealing the filling openings which is arranged on the middle radius after said containers have been filled by a treatment unit arranged on the outermost radius 3 in the state as exhibited in FIG. 1. In the course of the next 360° rotation, which is not illustrated further in the drawing, the containers which now move on the innermost radius 5, for example, are screwed closed by means of a treatment unit 8*c* which is situated on the innermost radius 5.

Following the movement of the containers arranged in the receiving places 1 on the innermost radius 4, the containers again move on the middle radius 4 following a further rotation by 90° of the interior carrousel 2. This time, however, they move in angular ranges which depart from the first state as exhibited in FIG. 1. The departing angular ranges allow the arrangement of several treatment units assigned to different angular ranges on the same predetermined radius, thus offering the possibility for the arrangement of a total of four treatment units in the functional mode of the exhibited embodiment of a turntable in accordance with the invention. The treatment in the described fourth position can also include the possibility that the containers are taken from the receiving places at this position.

As a result, with the illustrated embodiment of a turntable in accordance with the invention, it is possible to treat a maximum of 32 containers received in receiving places 1 by a maximum of four treatment units on three predetermined radii 3, 4, 5.

In the illustrated embodiment, the interior carrousels 2 are each provided with four receiving places. It is also possible, for example, that only two or also 5, 6 or more receiving places are arranged per interior carousel. The rotation of the interior carrousel 2 by 90' as exhibited in an exemplary manner in the illustrated embodiment between the position 3:00 o'clock and 1:30 o'clock only represents an example. It is understood that rotations of the interior carrousel are possible with the help of which the receiving places are rotatable on more or less than three radii of the turntable.

What is claimed is:

1. A turntable for the treatment of container for fillable goods with receiving places for the container and with at least one treatment unit for the container received in the receiving places, wherein the receiving places are arranged in interior carrousels arranged on the turntable, wherein the interior carrousels are provided with rotary drives for rotating the receiving places on at least two predetermined radii of the turntable and at least one treatment unit each for the container is arranged on the predetermined radii, and wherein two treatment units which are assigned to different angular ranges are provided on the predetermined radii between the outermost radius and the innermost radius of the receiving places.

2. A turntable as claimed in claim 1, characterized in that the rotary drives of the interior carrousels (2) are arranged as stepper motors.

3. A turntable as claimed in claim 1, characterized in that the receiving units (1) are arranged to receive stand-up pouches.

4. A turntable for the treatment of container for fillable goods with receiving places for the container and with at least one treatment unit for the container received in the receiving places, wherein the receiving places are arranged in interior carrousels arranged on the turntable, wherein the interior carrousels are provided with rotary drives for rotating the receiving places on at least two predetermined radii of the turntable and at least one treatment unit each for the container is arranged on the predetermined radii, wherein the rotary drives of the interior carrousels are arranged as stepper motors.

5. A turntable as claimed in claim 4, wherein the receiving units are arranged to receive stand-up pouches.

6. A turntable for the treatment of container for fillable goods with receiving places for the container and with at least one treatment unit for the container received in the receiving places, wherein the receiving places are arranged in interior carrousels arranged on the turntable, wherein the interior carrousels are provided with rotary drives for rotating the receiving places on at least two predetermined radii of the turntable and at least one treatment unit each for the container is arranged on the predetermined radii, wherein the receiving units (1) are arranged to receive stand-up pouches.

* * * * *